US005964073A

United States Patent [19]

Harper

[11] Patent Number: 5,964,073

[45] Date of Patent: Oct. 12, 1999

[54] BRICK LAYING AID

[76] Inventor: Michael Philip Harper, Church Farm, Thorndon, Eye, Suffolk IP23 7JR, United Kingdom

[21] Appl. No.: 08/831,094

[22] Filed: Apr. 1, 1997

[51] Int. Cl.[6] ..... E04G 21/22

[52] U.S. Cl. ..... 52/749.14; 52/749.1; 52/749.13; 52/DIG. 1; 33/410; 294/25; 294/62

[58] Field of Search ..... 52/DIG. 1, 749.1, 52/749.13, 749.14; 15/235.4, 235.3; 33/527, 407, 408, 410; 294/62, 137, 25

[56] References Cited

U.S. PATENT DOCUMENTS

| | | | |
|---|---|---|---|
| 2,585,283 | 2/1952 | Sommers | 33/410 |
| 3,153,507 | 10/1964 | House | 294/137 X |
| 3,937,511 | 2/1976 | Inzerill | 52/749.13 X |

FOREIGN PATENT DOCUMENTS

| | | | |
|---|---|---|---|
| 83426 | 4/1957 | Denmark | 52/235.4 |
| 2598738 | 11/1987 | France | 52/749.13 |
| 266020 | 8/1913 | Germany | 294/62 |
| 210162 | 9/1940 | Switzerland | 52/749.11 |

*Primary Examiner*—Carl D. Friedman
*Assistant Examiner*—Winnie S. Yip
*Attorney, Agent, or Firm*—Edwin D. Schindler

[57] ABSTRACT

A brick laying aid comprising a box-shaped container open at one end and one side to receive a brick as a relatively close fit between two side walls and lying against a base wall and an end wall which may be of adjustable thicknesses, one side wall having an opening enabling the brick to be finger pressed against the opposite side wall to hold the brick in place when the device is grasped by the hand across the base wall, which is equipped on the outside with a handle which may be adjustable for hand size.

7 Claims, 2 Drawing Sheets

BRICK LAYING AID

FIELD OF THE INVENTION

This invention relates to a brick laying aid.

BACKGROUND TO THE INVENTION

The invention aims, more especially, to provide a device which is intended to assist a general trade builder or D-I-Y enthusiast or gardener or other interested person in the building of a wall to the standards normally only achievable by an expert brick layer.

In the context of the invention, the term "brick" is employed in a generic manner to include standard bricks and blocks used in the construction of houses and other buildings, bricks and blocks used for the construction of garden walls and, more generally, any form of right rectangular building element normally laid with the aid of a cement mixture, referred to hereinafter as mortar.

BRIEF SUMMARY OF THE INVENTION

According to the invention, there is provided a brick laying aid which comprises a box-shaped container having one open side and one open end, said container being dimensioned to receive a brick as a relatively close fit between two opposite side walls, abutting against the base wall opposite the open side and against the end wall opposite the open end. Clearance within the container for application of a layer of mortar to the brick at the open side and the open end of the container, which has an opening in one side wall enabling the brick to be held in place by pressing said brick against the other side wall.

In a preferred embodiment, the container is intended to be gripped by hand across the outside of the base wall, enabling finger pressure to be applied to the brick to hold it in place. For facilitating this, the base wall is preferably provided with a strap-like handle, which may be adjustable for hand size to fit tightly over the back of the user's hand, on the outside of the base wall.

It will be understood that normal usage of the device will be to pick up and hold the container open side up, apply mortar layers to the brick at one side and one end, invert the device to place the brick in place, applying pressure to keep the brick in place as the open side of the container now faces down, and withdraw the container from the brick either upwardly or endwise. The brick as then laid has a clean face at one end, where the next brick is to be laid. The one end wall of the container is thus required to be relatively thin and it may be displaceable by adjusting screws along the length of the device.

Preferably, inside the free edge of the end wall of the container, there is provided a brush-like element to prevent mortar slipping to the end of the brick, which is an aid to accurate brick laying. The need for subsequent pointing or raking of joints can be substantially eliminated by providing an insert with a brush-like element along the inside of the free edge of at least one side wall of the container.

One or more bubble level indicators can be provided on the device if desired. More importantly, however, the outside face of one side wall is preferably marked with horizontal and vertical guide lines. The horizontal line enables a brick being laid to be lined up relatively to the horizontal string conventionally used as a guide when brick laying, whilst the vertical line, near the centre of the length of the device, enables a brick to be laid in alignment with the end of a brick in the preceding course of bricks.

BRIEF DESCRIPTION OF THE DRAWING FIGURES

A practical embodiment of brick laying aid in accordance with the invention is now described by way of example with reference to the accompanying drawings, in which.

DETAILED DESCRIPTION OF THE DRAWING FIGURES AND PREFERRED EMBODIMENTS

Figure 4:
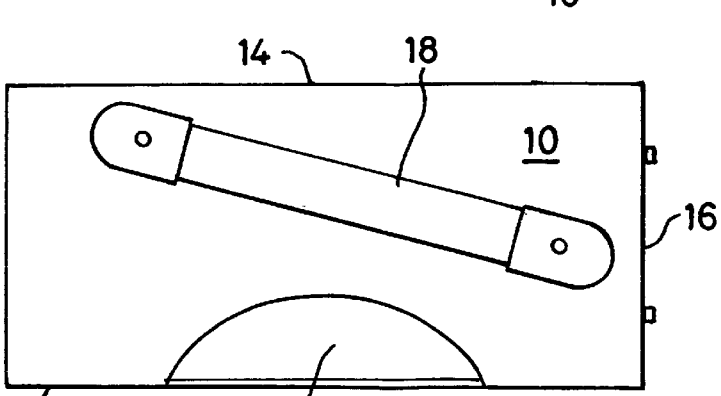
Figure 6:
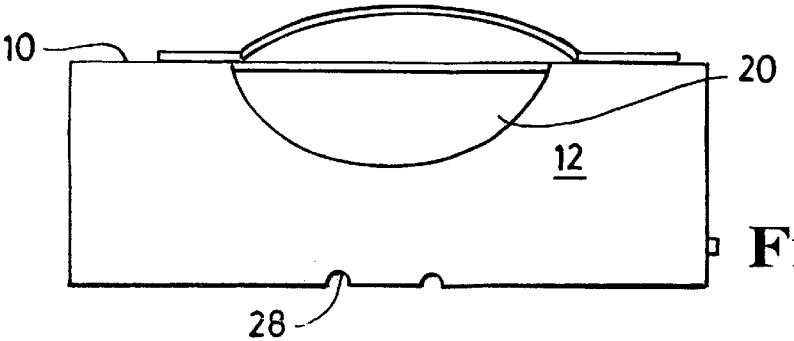

First, with respect to the drawings, it has to be appreciated that the device is inverted top to bottom during use, so that while FIG. 4 is said to be a bottom view showing the so-called base wall of the container, this is for convenience of terminology only, and is not material to the invention.

The illustrated brick laying aid comprises a container, preferably of stainless steel but possibly of plastics material, dimensioned to receive a brick, as hereinafter described. The container has a base wall 10, two side walls 12, 14 and one end partial wall 16. The base wall 10 has an exterior strap handle 18, and an opening 20 is formed in a region of one side wall 12 and adjoining region of the base wall.

The exterior of the side wall 14 is marked with horizontal and vertical guide lines 24, 26.

Figure 5:
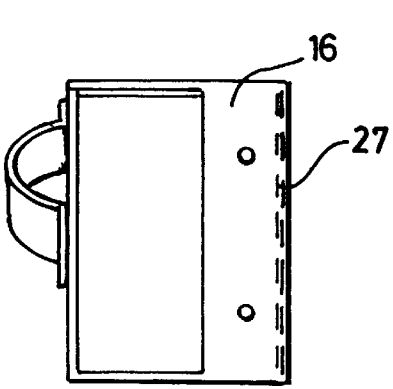

A brush-like element 27, for example in the form of draught excluding strip, is provided along the inside of the free edge of the partial end wall 16, remote from base wall 10 (FIG. 5). An insert with a similar brush-like element attached may also optionally be located on the inside of either one or both side walls.

Grooves 28 provided in the free edge of the side wall 12 may provide for the location of wall ties.

Figure 1:
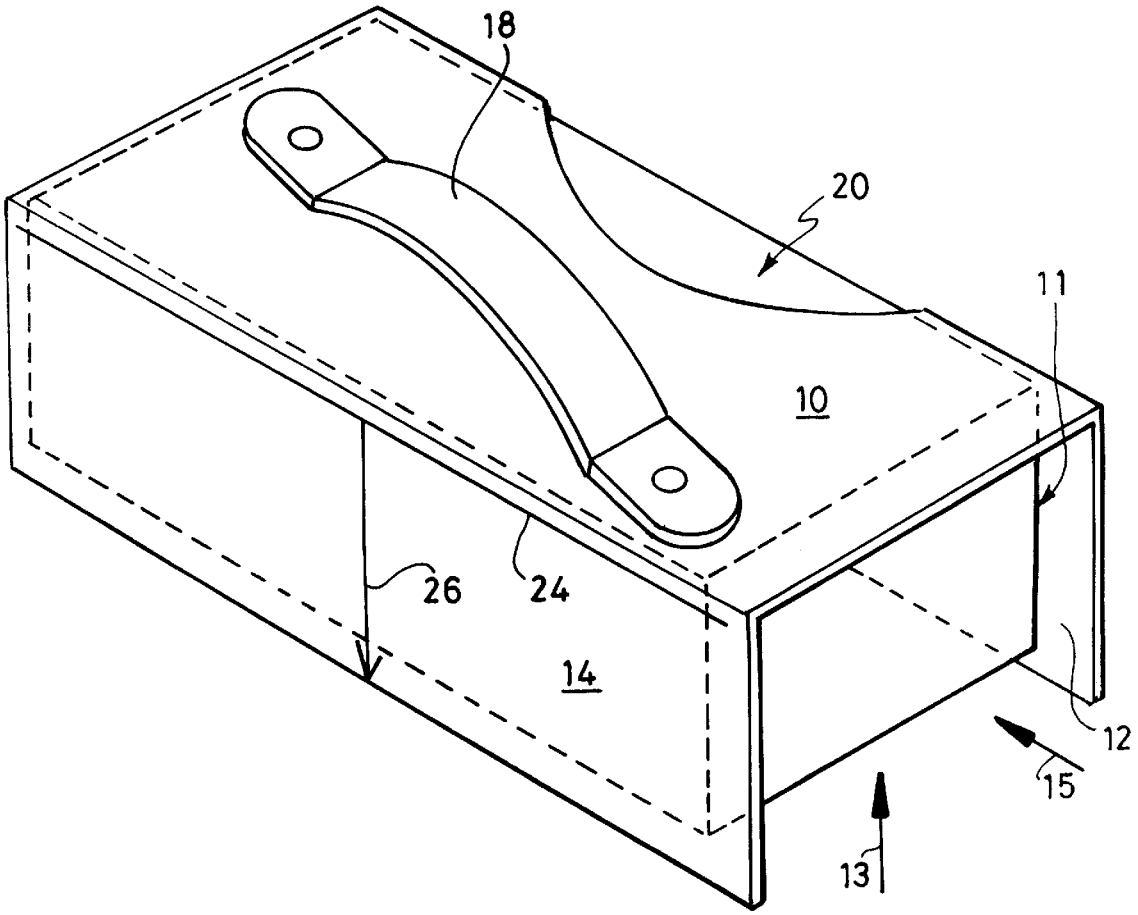
FIG. 1 is a perspective view of the device.
Figure 2:
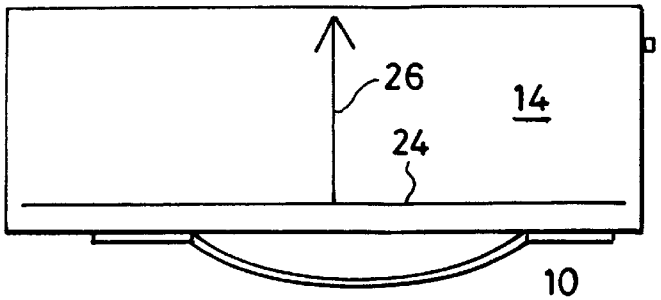
FIGS. 2 to 6 show the device in side view, open end view, bottom view, closed end view and opposite side view, respectively.

In use, the device is held by inserting a hand through the strap handle 18, for example comprising Velcro (Trade Mark) parts which can be adjusted so that the handle will fit tightly across the back of the hand. The device is first held base wall up, so that a brick can be picked up with the device, the container being dimensioned so that this brick fits relatively closely between the side walls 12 and 14. FIG. 1 shows the device with a brick being held in place. The brick 11 is located against the end wall 16, and in this condition, when the device is inverted, clearance 13 is left in the device at the top and one clearance 15 at end for the application of an even layer of mortar to the exposed faces of the brick. This is contrary to conventional practice, in which mortar is applied to the bricks already laid.

Gripping the brick tightly against the one side wall 14 by means of the opening 20 at the opposite side of the container, the device is now inverted again to lay the brick in position on top of and next to bricks previously laid. Properly mixed mortar is highly adherent, and does not fall from the brick during the step of laying the brick, whereby the appropriate thicknesses of mortar are created, with the previously laid bricks respectively below and to one side.

The brush-like element 27 on the inside of the end wall of the container prevents mortar slipping to the end of the brick, which can create non-alignment of the brick with bricks already laid. Principally, however, alignment is ensured by aligning the horizontal guide line 24 with the horizontal string conventionally used as a brick laying guide, and by aligning the vertical guide line 26 with the end of the appropriate brick of a preceding course of bricks. A plumb line can be employed to ensure verticality, or one or more bubble level indicators can be provided on the device.

If an insert with a brush-like element attached is provided on the inside of at least one side wall, subsequent pointing or raking of joints can also be minimised.

The above-described brick laying aid enables a non-expert brick layer to achieve consistent, level vertical and horizontal joints, with automatic compensation (in mortar thicknesses) for fluctuations in brick sizes. Clean brick faces are obtained, with minimal wastage of mortar, and a clean cavity is obtained in the case of cavity walls.

Figure 3:
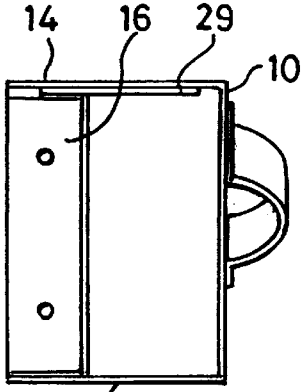

Possible modifications of the above-described device include right-hand and left-hand versions, and manufacture as two relatively adjustable L-sectioned parts, so as to cater for bricks of varying widths. On the inside wall of the device opposite the opening 20, a thin rubber facing 29 (FIG. 3) may be provided to reduce the finger pressure necessary to hold the brick in place. A rubber or other guard may be provided around the edge of the opening to protect the fingers.

Another important feature which should be mentioned is that the end edge of the end wall, on the open side of the device, may terminate slightly short of the edges of the side wall, so that when laying a brick the side walls engage by a small amount, due to compression of the mortar, over the sides of the bricks in a previously laid course of bricks, thereby assisting alignment. Moreover, at the open end of the device, a very thin pop-out spring may be provided for the same purpose.

I claim:

1. A brick laying aid in combination with a brick, comprising a box-shaped container having a base wall, two side walls and an end wall, with an open side opposite to the base wall and an open end opposite to the end wall, said container being dimensioned receiving the brick as a relatively close fit between two opposite side walls, said brick abutting against the base wall and against the end wall, and leaving a clearance within the container between the brick and the container for application of a layer of mortar to the brick at the open side and the open end of the container, and said container having an opening in one side wall enabling the brick to be held in place by pressing said brick against the other side wall.

2. A brick laying aid as claimed in claim 1, wherein the base wall is provided on the outside with a handle.

3. A brick laying aid as claimed in claim 1, having a brush-like element inside the free edge of the end wall of the container.

4. A brick laying aid as claimed in claim 1, having horizontal and vertical guide lines for alignment purposes marked on the exterior face of at least one side wall.

5. A brick laying aid as claimed in claim 1, wherein the edge of the end wall on the open side of the container is recessed relative to the longitudinal edges of the side walls.

6. A brick laying aid as claimed in claim 1, having a friction facing on an interior face of the side wall opposite the opening.

7. A brick laying aid as claimed in claim 1, wherein one of said side wall of said container has a free edge with grooves being provided in the free edge for locating wall ties.

* * * * *